United States Patent [19]

Parker

[11] 4,425,749

[45] Jan. 17, 1984

[54] FURNACE LINING MODULE

[75] Inventor: William H. Parker, Mt. Lebanon, Pa.

[73] Assignee: Manville Service Corporation, Denver, Colo.

[21] Appl. No.: 330,285

[22] Filed: Dec. 14, 1981

[51] Int. Cl.[3] ..... E04B 1/80

[52] U.S. Cl. ..... 52/509; 52/275; 52/404

[58] Field of Search ..... 52/270, 506, 509, 404, 52/511, 513, 405, 597, 275, 267, 285, 592, 743, 699, 747; 110/1 A, 99; 428/99, 126, 184, 176

[56] References Cited

U.S. PATENT DOCUMENTS

| | | | |
|---|---|---|---|
| 3,819,468 | 6/1974 | Sauder et al. | 52/270 X |
| 3,952,470 | 4/1976 | Byrd | 52/513 X |
| 4,001,996 | 1/1977 | Byrd | 52/509 |
| 4,012,877 | 3/1977 | Byrd | 52/275 |
| 4,194,282 | 3/1980 | Byrd | 52/509 X |
| 4,202,148 | 5/1980 | Frahme | 52/506 X |
| 4,339,902 | 7/1982 | Mochowski et al. | 52/509 X |

*Primary Examiner*—J. Karl Bell

*Attorney, Agent, or Firm*—R. M. Halvorsen; J. D. Lister; R. K. Thomson

[57] ABSTRACT

An L-shaped insulating module for use on outside and inside corners as well as on door jambs in a high temperature furnace. A module of refractory fibers is constructed of one blanket folded in accordance with a particular sequence to produce a first region with a first number of layers and a second region with a second lesser number of layers which is generally half as many as the first number. One-half of each of the second layers is removed to produce an L-shaped component. A second component member is interleaved with the layers of the second region to produce an L-shaped module of uniform thickness. Mounting hardware is attached to two faces of the module for attachment to their respective wall faces. The attachment is such that it retains the two components in assembled condition.

10 Claims, 3 Drawing Figures

FURNACE LINING MODULE

FIELD OF INVENTION

The present invention is directed to refractory blocks for lining furnaces and the like. More particularly, the present invention is directed to a specially configured refractory fiber modular article for use in lining the areas around door jambs, in corners and near other such discontinuities.

BACKGROUND AND SUMMARY OF THE INVENTION

Recently, the use of refractory fiber blankets as furnace linings has become increasingly popular. Still more recently, the use of serpentine modules of refractory fiber blankets as furnace lining material has been developed (see U.S. Pat. Nos. 3,952,470 and 4,001,996). These modules employ a mounting system that makes possible easy and fast installation as compared to other furnace linings. Further, the mountings are located on the back portion of the modules and are thereby insulated from the extreme temperatures inside the furnace.

To date, however, the door jambs continue to be insulated by conventional blankets with exposed or hidden pin systems. Even when "hidden" (covered by one or more layers of refractory material), these pins are proximate the hot face of the furnace and, therefore, subjected to extreme heat which can melt, or otherwise damage, the pins causing them to unfasten the blanket. In addition, these pins are heat sinks which transfer heat to the furnace walls defeating the lining. Other areas of difficulty are the inside and outside corners caused by changes in cross section and other discontinuities within the furnace. It is difficult with the presently available modules to properly insulate these areas and to avoid gaps. Accordingly, significant heat losses directly to the furnace walls can result.

The present invention provides a solution to the problems caused by these troublesome areas. A particularly configured modular article enables door jambs, inside and outside corners, and other discontinuities within the furnace to be quickly and conveniently insulated. This L-shaped module is made by folding a refractory fiber blanket in a particular sequence to create projecting layers, removing a portion of the projecting layers, interweaving a second blanket in serpentine fashion to fill the gaps and create a module having generally uniform thickness. The module is then provided with mounting means on two adjacent faces for mounting on their respective furnace walls.

Other features, characteristics and advantages of the present invention will become apparent after a reading of the following specification.

DETAILED DESCRIPTION OF THE PREFERRED EMBODIMENTS

Figure 1:
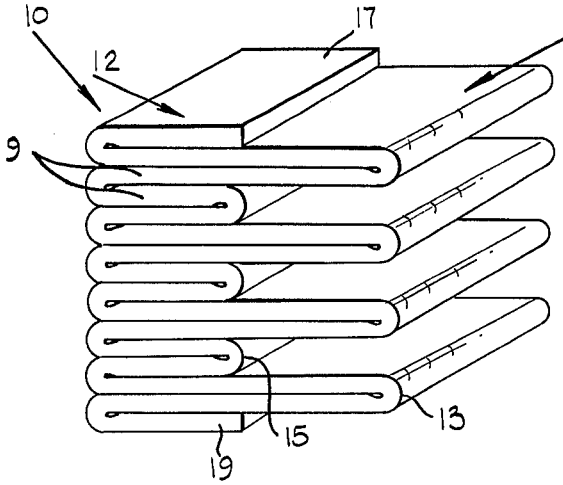
FIG. 1 is a perspective view of a fibrous blanket folded in accordance with the method of the present invention to form an element from which the first component is made.

A first component member of the module of the present invention is made from a folded element which is shown generally at 10. This element 10 is comprised of an insulating blanket generally of the type disclosed in U.S. Pat. No. 4,001,996, which description is incorporated herein by reference. The blanket is preferably composed of alumina-silica refractory fibers and capable of withstanding exposure to the high temperatures within a furnace. The blanket in element 10 is folded in a particular repetitive sequence which will be discussed more fully hereinafter. This fold sequence defines a first region 12 with a first number 'x' of layers 9 and a composite thickness '$t_1$' and a second region 14 with a second number 'y' of layers 9 and a composite thickness '$t_2$', where 'x' is greater than 'y' and '$t_1$' greater than '$t_2$'. It will be understood that the "composite thickness" includes only the thickness of the layers and not the dimensions of the interstices.

The next step in the method of making the module of the present invention is to remove a portion of each of the 'y' layers of this second region. Generally, it is preferred that substantially one-half of each of the layers in region 14 is removed. The remaining member or component 11 has an L-shaped configuration and defines a first leg portion 16 and a second leg portion 18. This configuration may, of course, be varied, depending on the specific configuration of the furnace surfaces to which the module is to be attached. The particular module described here is designed to be attached to a corner, either inside or outside, where the surfaces of the walls are smooth.

Figure 2:
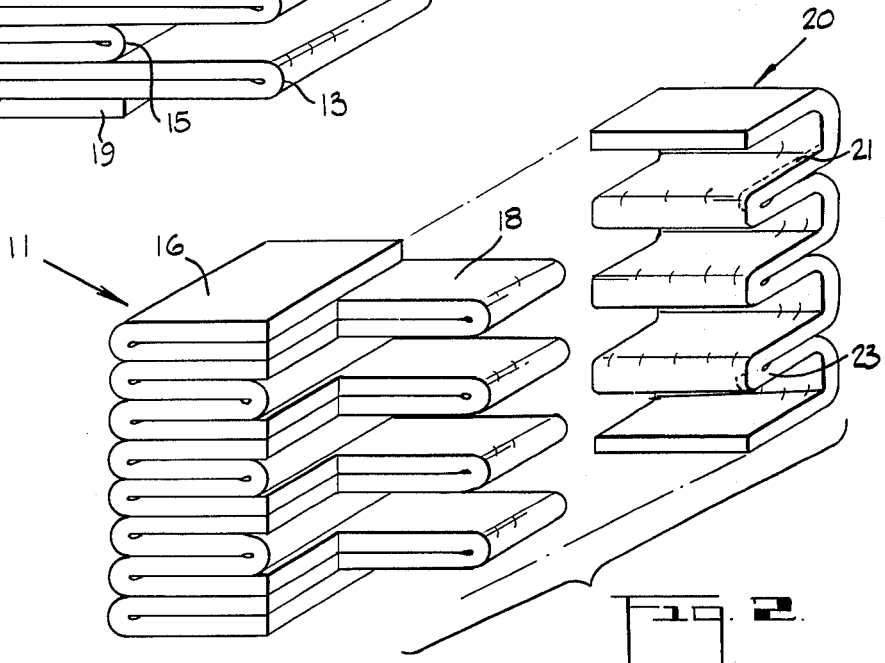
FIG. 2 is an expanded perspective view showing both components of the module of the present invention.

As depicted in FIG. 2, a second component member 20 is utilized in formulating the module of the present invention. Preferably, member 20 is comprised of a suitable length and width of refractory fiber blanket of the same type as used in member 11. This member 20 is then interleaved with the layers of leg 18 to form a solid L-shaped module. Preparatory to interleaving member 20 with member 11, member 20 may be formed into an appropriate serpentine configuration and maintained in this shape by "needling" adjacent layers as described in the aforesaid patent. Member 20 has a number of layers 'z' with a composite thickness '$t_3$'.

Figure 3:
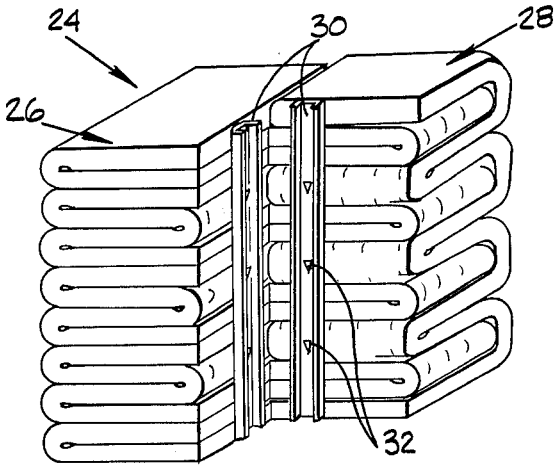
FIG. 3 is a perspective view of a completed module of the present invention for use on an outside corner.

One form of completed module 24 is depicted in FIG. 3. Module 24 has first and second arms 26 and 28 formed by its L-shaped form. Arm 26 corresponds to leg 16 of component member 11 and, accordingly, has 'x' layers and a thickness '$t_1$'. Arm 28 is formed by leg 18 of member 11 with member 20 interwoven therewith. Therefore, arm 28 has a composite '$y+z$' number of layers and a composite thickness of '$t_2+t_3$'. In the preferred embodiment, $y=z=\frac{1}{2}x$ and $t_2+t_3=t_1$. Mounting brackets 30 are secured to portions of arms 26 and 28 in a manner taught in U.S. Pat. No. 3,952,470 which is hereby incorporated in pertinent part by reference. As described therein, a plurality of T-shaped supports are positioned in the folds of arms 26 and 28 with tabs 32 of the 'T' penetrating the blanket, being received in a slot in the bracket 30, and then being folded over to maintain the module in assembled condition.

The module depicted in FIG. 3 has been equipped for attachment to a door facing or an outside corner (i.e., one that projects into the interior of a furnace). Mounting brackets 30 could, however, be placed on the opposite faces of arms 26 and 28 such that the module would be appropriate for installation on an inside corner. In such an event, members 11 and 20 may be "needled" together in order to prevent their disassociation. Alternatively, portions of member 20, such as layers 21 and 23, could be shaved as depicted by the dotted line in FIG. 2 to remove an amount approximately equal to the mat layer thickness. By removing such an amount from these layers which extend from the inner edge to the outer edge of the arm of the 'L', the serpentine member 20 might be inserted between adjacent layers 18 of member 11 to prevent the two components from being pulled apart, either by their own weight or otherwise.

As heretofore mentioned, the blanket of element 10 is folded in accordance with a particular repetitive sequence. Undoubtedly, a large number of possible sequences would produce satisfactory modules. However, that which is depicted in FIG. 1 is considered the preferred embodiment. In this module, the blanket is folded alternately into a series of long and short folds 13 and 15, respectively, with upper and lower flaps 17 and 19. It will be understood that single repetitions of 13 and 15 are shown as exemplary. However, folds 13 and 15 could be reproduced in other sequences as well such as 2 and then 2, 1 and then 2 or 2 then 1, for example.

The modular article of the present invention is particularly adapted for use with the serpentine modules of refractory fibers sold by Johns-Manville Corporation under the trademeark "Z-BLOK". This specially configured module enables the troublesome areas of door jams and corners to be more easily and effectively insulated and substantially enhances the benefits of the system.

Various changes, modifications and alternatives will become apparent to a person of ordinary skill in the art following a reading of the foregoing specification. Accordingly, it is intended that all such changes, modifications and alternatives as come within the scope of the appended claims be considered part of the present invention.

I claim:

1. An article for insulating portions of two walls in the region of a corner or similar discontinuity in a furnace, said article comprising an L-shaped module with first and second multi-layered arm portions including a first generally L-shaped member with first and second multi-layered leg portions, said first leg portion corresponding generally to said first arm portion, a second member interleaved in serpentine fashion with said second leg portion to form said second arm portion, means to attach said first and second arm portions to their respective furnace walls.

2. The insulating article of claim 1 wherein said second member augments the thickness of the layers of said second leg portion to a thickness substantially equal to that of the layers of said first leg portion.

3. The insulating article of claim 2 wherein said second member contributes one-half of the number of layers of said second arm portion.

4. The insulating article of claim 1 wherein said first member comprises a single, continuous sheet folded into layers, the layers of said first member being formed as alternate long and short folds.

5. The insulating article of claim 1 wherein said first and second members comprise blankets of refractory fibers.

6. A method of making a modular article to insulate portions of two walls in the region of a corner or similar discontinuity in a furnace comprising the steps of:

(a) folding a first insulative blanket in a particular repetitive sequence to define an element from which a first component will be formed, said element having a first region with 'x' number of layers and a composite thickness '$t_1$' and a second region with 'y' number of layers and a composite thickness '$t_2$' with 'x'>'y' and '$t_1$'>'$t_2$';

(b) removing a portion of the layers in said second region of said element to form a generally L-shaped first component;

(c) interleaving a second component with the layers of said second region, the resulting layers of said second component numbering 'z' and having a thickness '$t_3$'; and (d) securing means of attachment to one side of each region for securement to said respective furnace wall; such that the resulting module has a first multi-layered region with a thickness '$t_1$' and a second multi-layered region with a composite thickness '$t_2$'+'$t_3$'.

7. The method of claim 6 wherein '$t_2$'+'$t_3$' is substantially equal to '$t_1$'.

8. The method of claim 6 wherein the number of layers 'y' in the second region of the first component plus the number of layers 'z' in the interleaved second component equal the number of layers 'x' in the first region of said first component.

9. The method of claim 8 wherein 'y'='z'=$\frac{1}{2}$'x'.

10. The method of claim 6 wherein said particular repetitive sequence alternately forms long and short folds.

* * * * *